US005254032A

United States Patent [19]

Abe

[11] Patent Number: 5,254,032

[45] Date of Patent: Oct. 19, 1993

[54] COIN FEEDING DEVICE

[75] Inventor: Hiroshi Abe, Tokyo, Japan

[73] Assignee: Asahi Seiko Kabushiki Kaisha, Tokyo, Japan

[21] Appl. No.: 915,013

[22] Filed: Jul. 16, 1992

[30] Foreign Application Priority Data

Jul. 19, 1991 [JP] Japan ..... 3-269963

[51] Int. Cl.[5] ..... G07D 1/00

[52] U.S. Cl. ..... 453/56; 453/57; 221/182

[58] Field of Search ..... 453/32, 56, 57; 221/182, 203

[56] References Cited

U.S. PATENT DOCUMENTS

| | | | |
|---|---|---|---|
| 3,818,918 | 6/1974 | Nissmo et al. | 453/57 |
| 4,589,433 | 5/1986 | Abe | 221/203 X |
| 4,681,204 | 7/1987 | Zimmermann | 453/32 X |
| 5,000,718 | 3/1991 | Abe | 453/57 |

FOREIGN PATENT DOCUMENTS

| | | | |
|---|---|---|---|
| 2510230 | 9/1976 | Fed. Rep. of Germany | 453/32 |
| 2208738 | 4/1989 | United Kingdom | 453/57 |

*Primary Examiner*—F. J. Bartuska

*Attorney, Agent, or Firm*—Hopgood, Calimafde, Kalil, Blaustein & Judlowe

[57] ABSTRACT

A coin sorting device comprises a hopper (4) for holding a supply of coins. Within the hopper (4), a coin feeding disc (2) is provided for feeding the coin to a coin outlet (26). A coin transporting piece carrier (5) is rotated in synchronism with the coin feeding disc (2). The coin transporting piece carrier (5) is inclined to the coin feeding disc (2) at a predetermined angle. A plurality of coin transporting pieces (8) are protruded from the coin transporting piece carrier (5) passing through coin transporting piece reception holes (9, 10). A coin feeding belt (28) extends from the upper portion of the coin feeding disc (2) to the coin outlet (26). The coin is delivered in contact relation with the coin feeding belt (28). A belt driving pulley (33) is rotated by means of the coin feeding disc (2) in a frictionally well-contact relation therewith.

6 Claims, 3 Drawing Sheets

COIN FEEDING DEVICE

BACKGROUND OF THE INVENTION

This invention relates to a coin feeding device, for use in coin exchangers, coin operated gaming machines or the like, which feeds predetermined number of coins one by one held in a hopper in bulk.

The coin feeding devices of this kind is disclosed in U.S. Pat. No. 4,589,433, issued on May 20, 1986 and U.S. Pat. No. 5,000,718, issued on Mar. 19, 1991. Such a coin feeding device comprises a hopper for holding a supply of coins or tokens in bulk. Within the hopper, a rotary disc is rotatably disposed and is provided with a central circular stage. A plurality of coin transporting pins are provided with a carrier. The pins are protruded in a peripheral portion around the central circular stage and spaced apart in the peripheral direction of the rotary disc. Further, a coin delivery guide is extended across the peripheral portion of the rotary disc for guiding coins on the peripheral portion to an outlet chute. The carrier having a plurality of coin transporting pins spaced apart in the circumferential direction is rotatably supported at the rear side of the rotary disc. The carrier is rotated at an angle to the rotary disc such as to extrude the pins extended through the rotary disc from the surface of the peripheral portion of the rotary disc in a minimum amount at a position of the delivery guide and in a maximum amount at a coin picking up position.

Thus, such structure allows the coin feeding device to improve the function of picking up coins from the bottom portion of the hopper by means of a long transporting pin. In this event, coins are transported without jamming in the upper delivery portion. In addition, it is possible for this device to improve a coin dispensing efficiency by providing means for agitating coins in the lower portion of the hopper. In other words, it is possible to increase the number of coins transported per second. In particular, in the coin feeding device disclosed in the above mentioned U.S. Patent, there is no problem of Interference between the outlet chute and the coin transporting pins.

Recently, it has been desired to further improve coin dispensing efficiency of the device. For satisfying such demand, it can be considered to increase the rotation speed of the rotary disc or to increase the diameter of the rotary disc. However, in the coin feeding device of the type described, there is a defect that increased rotation speed of the coin feeding disc results in uncertain operation thereof. In particular, with the coin feeding device as described in the above mentioned U.S. Pat. No. 4,589,433, coins are delivered to an outlet chute by means of a delivery knife or the coin delivery guide and a counter roller. The counter roller is provided opposite upwardly to the delivery knife. When the coin feeding disc is rotated at a relatively high speed, a coin will not necessarily delivered just to the outlet chute. Accordingly, in such a coin feeding device, it is necessary to restrict the rotation speed of the coin feeding disc for securing reliable operation thereof.

In addition, the centrifugal force inevitably acts to the rotary-disc, which causes the coins move outwards. Because of the centrifugal force, a coin tends to leave its passage or to fly off the disc. This problem is more serious when the rotary disc is rotated at a relatively high speed.

In order to overcome such problems, a coin sorting device has been developed where the rotary disc is rotated at a high speed. In this device, the coins are radially outwardly transported on the rotary disc with effectively utilizing the centrifugal force. More particularly, the coins are guided to the outlet chute by means of a peripheral guide member, an outlet guide member or the like arranged at the peripheral portion of the rotary disc.

However, in the coin sorting device of the type described, a large dish-like hopper is generally used in order to smoothly supply an adequate number of coins. In addition, it is necessary to use a rotary disc having large diameter to prevent the coins flying away of the disc. This results in the device being enlarged.

SUMMARY OF THE INVENTION

It is an object of the present invention to solve the aforementioned problems.

More specifically, an object of the present invention is to provide a coin feeding device where coin feeding efficiency can be improved by increasing the rotation speed of the coin feeding disc without enlarging the device.

It is another object of the present invention to provide a coin feeding device which effectively feeds coins by utilizing the centrifugal force.

It is yet another object of the present invention to provide a coin feeding device where no coin tends to leave its passage or to fly off the disc.

It is further object of the present invention to provide a coin feeding device having a relatively small hopper for holding a supply of coins in bulk.

According to the present invention, a coin feeding device comprises a rotary plate having a front surface on one side where a coin Is loaded at a lower portion thereof and a rear surface on the other side, said rotary plate is for use in feeding said coin to a coin outlet located at or around a periphery of said front surface; a coin transporting piece receiving hole which is penetrating through said rotary plate; a coin transporting piece carrier which is rotated in synchronism with said rotary plate in an opposed position inclined to said rear surface of said rotary plate at a predetermined inclination angle; and a coin transporting piece protruded from said coin transporting piece carrier, said coin transporting piece projects from said front surface passing through said coin transporting piece receiving hole, wherein said coin transporting piece catches said coin at a lower portion of said front surface and feeds it to an upper portion of said front surface, and said predetermined inclination angle is in the range such that said coin transporting piece is substantially extended from said front surface as said coin transporting piece approaches the lower portion from the upper portion of said front surface, and that said coin transporting piece Is substantially withdrawn in said front surface as said coin transporting piece approaches the upper portion from the lower portion of said front surface, said device further comprising coin feeding belt means for feeding said coin to said coin outlet from the upper portion of said front surface, wherein said coin feeding belt means comprises a belt member extending from the upper portion of said front surface to said coin outlet in such a manner that said coin is to be contact therewith; and a belt driving member for driving said belt portion in a rotation direction of said rotary plate.

According to the present invention, it is preferable that the coin feeding belt means comprises a belt driving pulley and two guide pulleys, which are arranged at the vertexes, respectively, of a triangle extending on a plane of the coin feeding disc; and an endless belt passing around these pulleys, wherein the coin feeding belt portion is extended between both guide pulleys and the belt driving pulley is driven in a peripheral portion of the coin feeding disc with frictionally contacting therewith.

BRIEF DESCRIPTION OF THE DRAWING

Further objects and advantages of the present invention will become apparent as the following description of an illustrative embodiment proceeds with reference to the drawings in which.

DETAILED DESCRIPTION OF THE PREFERRED EMBODIMENT

Description will be made regarding to an embodiment of the present invention with reference to FIGS. 1 through 3.

Figure 1:
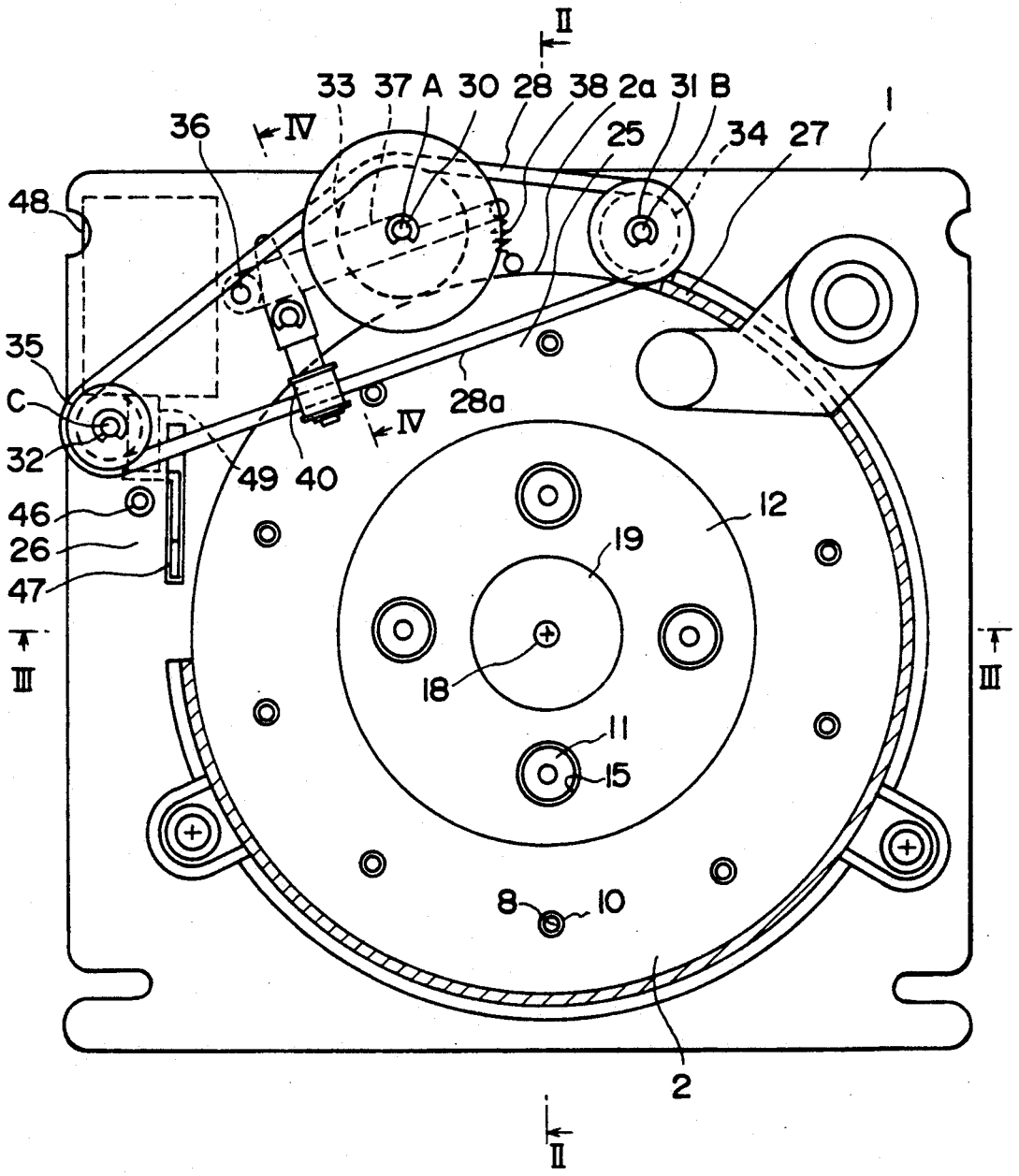
FIG. 1 is a schematical top view taken on line I—I in FIG. 2 showing an embodiment of the coin feeding device according to the present invention.
Figure 2:
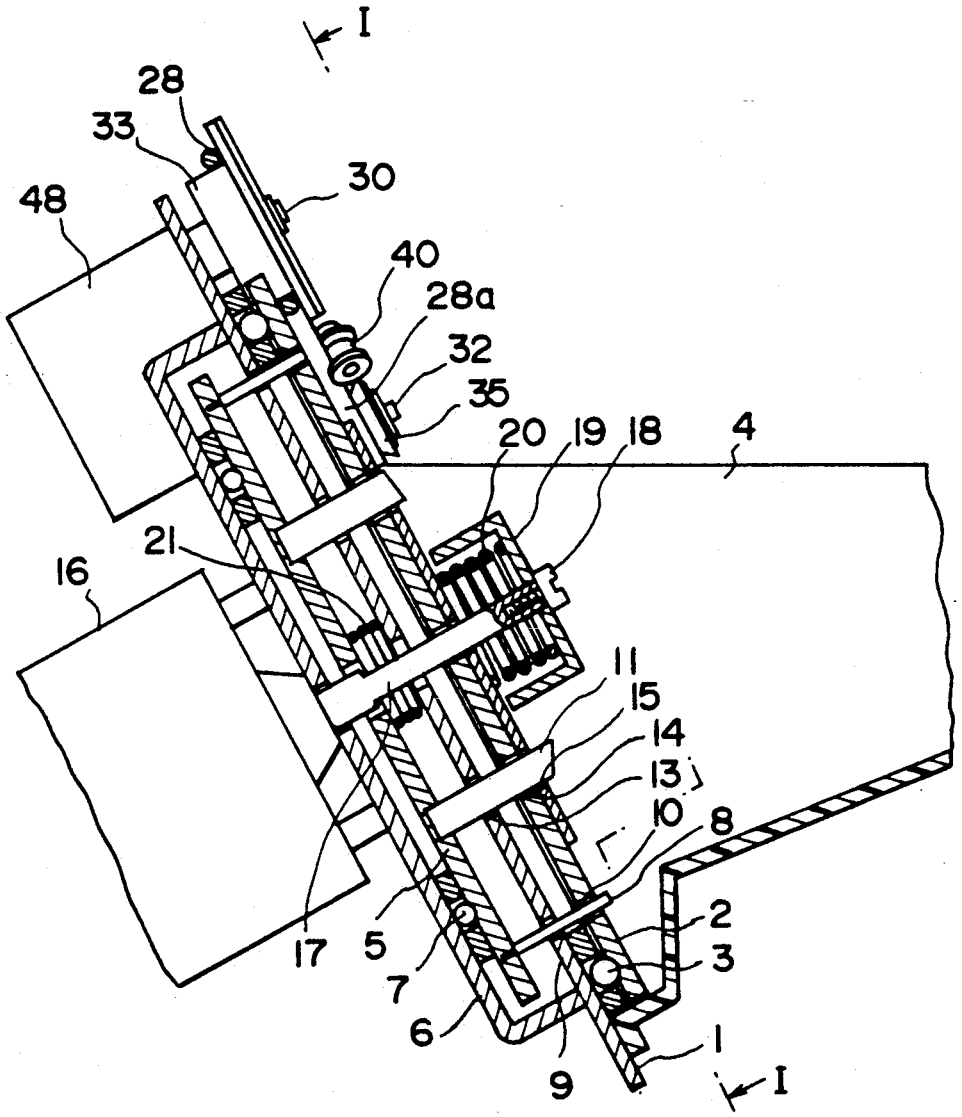
FIG. 2 is a schematical sectional view of the coin feeding device taken on line II—II in FIG. 1.
Figure 3:
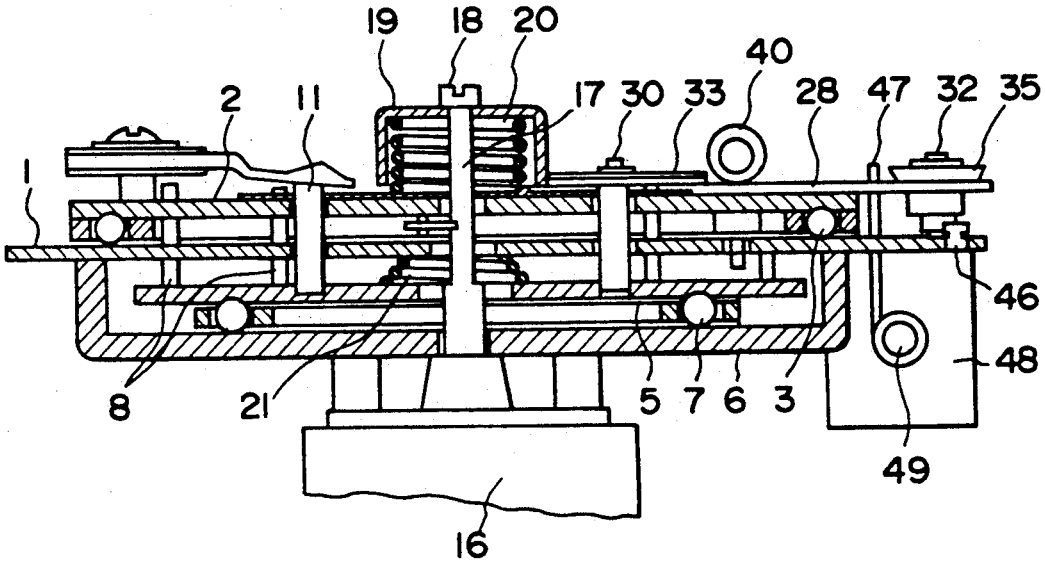
FIG. 3 is a sectional view taken on line III—III in FIG. 1.

Referring to FIGS. 1 through 3, an illustrated coin feeding device comprises an inclined base plate 1. The inclined base plate 1 is secured on a fixed supporting frame (not shown). The inclined base plate 1 is secured in a position inclined to the horizontal at a predetermined angle. In this embodiment, the angle between the inclined base plate 1 and the horizontal is 60 degrees. A coin feeding disc 2 is rotatably supported on the inclined base plate 1 at a peripheral portion thereof. The coin feeding disc 2 is supported by means of a circular thrust bearing 3. Such circular thrust bearing 3 is disclosed in, for example, Japanese Patent Examined Publication No. Tokko-hei 3-9512. The coin feeding disc 2 has a front surface on one side and a rear surface on the other side. As will later be described more detail, a coin Is loaded at a lower portion of the front surface and transported to a coin outlet located at or around a periphery of the front surface. In addition, the coin feeding device also comprises a hopper 4 for holding a supply of coins in bulk. The hopper 4 Is mounted in such a manner that it surrounds the lower portion of the coin feeding disc 2.

A carrier supporting disc 6 is fixed to the rear surface of the inclined base plate 1. Between an inner surface of the carrier supporting disc 6 and the rear surface of the coin feeding disc 2, a coin transporting piece carrier 5 is rotatably supported. The coin transporting piece carrier 5 is rotated in synchronism with the coin feeding disc in a manner as described below. The coin transporting piece carrier 5 is inclined to the rear surface of the coin feeding disc 2 at a predetermined angle. In the illustrated embodiment, the coin transporting piece carrier 5 is inclined to the inclined base plate 1 at an angle of 5 degrees. A circular thrust bearing 7 Is provided with the carrier supporting disc for supporting the coin transporting piece carrier 5 in the same manner as described in the above mentioned U.S. Pat. No. 5,000,718. The circular thrust bearing 7 is similar to the circular thrust bearing 3.

A plurality of cylindrical coin transporting pieces 8 are protruded from the coin transporting piece carrier 5 at the peripheral portion thereof. Each of the coin transporting pieces 8 is protruded from the coin transporting piece carrier 5 towards the coin feeding disc 2. The coin transporting pieces 8 are equally spaced apart from each other in the circumferential direction of the coin transporting piece carrier 5. First coin transporting piece receiving holes 9 are provided with the inclined baseplate 1. Each of the first coin transporting piece receiving holes 9 penetrates the inclined base plate 1. Similarly, second coin transporting piece receiving holes 10 are provided with the coin feeding disc 2. Each of the second coin transporting piece receiving holes 10 penetrates the coin feeding disc 2. Both of the first and second coin transporting piece receiving holes 9 and 10 are equal in number to the coin transporting pieces 8. The coin transporting pieces 8 project from the front surface passing through their respective coin transporting piece receiving holes 9 and 10.

At a central portion of the coin transporting piece carrier 5, a plurality of cylindrical coin agitating members 11 are protruded towards the coin feeding disc 2. The coin agitating members 11 are equally spaced apart with each other in the circumferential direction of the coin transporting piece carrier 5. Coin agitating member receiving holes 13, 14 and 15 are provided with the Inclined base plate 1, the coin feeding disc 2 and a central stage 12, respectively. The coin agitating member receiving holes 13 are equal in number to the coin agitating members 11. Similarly, both the coin agitating member receiving holes 14 and 15 are equal in number to the coin agitating member 11. The coin agitating members 11 pass through their respective coin agitating member receiving holes 13, 14, and 15.

A rotating shaft 17 Is driven through a built-in reduction gear (not shown) by means of a motor 16. The motor 16 is supported on the carrier supporting disc 6. The rotating shaft 17 is extended through the carrier supporting disc 6, the coin transporting piece carrier 5, the inclined base plate 1 and the coin feeding disc 2. A cap 19 Is fixed to the top of the rotating shaft 17 by means of a screw 18. Tn addition, a first biasing member 20 is interposed between the coin feeding disc 2 and the cap 19. A second biasing member 21 is interposed between the inclined base plate 1 and the coin transporting piece carrier 5. In the illustrated embodiment, both of the first and second biasing members are in the form of springs. Thus, the central portion of the coin feeding disc 2 is urged towards the inclined base plate 1 to rotatably support the coin feeding disc 2 on the inclined base plate 1 through the thrust bearing 3. Similarly, the central portion of the inclined base plate 1 is urged towards the carrier supporting disc 6 to rotatably support the Inclined base plate 1 on the carrier supporting disc 6 through the thrust bearing 7.

The coin feeding disc 2 and the coin transporting piece carrier 5 are drivingly connected with each other in a well known manner. Accordingly, they are rotated in synchronism with each other with the rotating shaft 17. More particularly, when the coin feeding disc 2 is rotated by the rotating shaft 17, the coin transporting piece carrier 5 is synchronously rotated with the coin feeding disc 2. As mentioned above, the coin transporting piece carrier 5 is inclined to the coin feeding disc 2 at an angle such that the protrusion amount of the coin transporting pieces 8 is substantially equal to zero at a coin outlet portion 25. At this coin outlet portion 25, the protrusion amount of the coin agitating members 11 is substantially minimum. On the other hand, at a position diametrically opposed to the coin outlet portion 25, each of the coin transporting pieces 8 and the coin agitating members 11 protrudes into the hopper 4 in a maximum amount. Accordingly, it is possible to effectively pick up coins in the hopper 4 as well as to improve coin agitating efficiency.

As mentioned above, around the coin outlet portion 25, no coin feeding piece 8 is protruded from the surface of the coin feeding disc 2. A coin feeding belt arrangement is provided near the coin outlet portion 25 for feeding the coins to the coin outlet portion 25 on the front surface of the coin feeding disc 2. The coin feeding belt arrangement comprises a coin feeding belt 28 and a belt driving member. In this embodiment, the coin feeding belt 28 is an endless belt. The coin feeding belt 28 extends from the upper portion of the front surface of the coin feeding disc 2 to the coin outlet portion 25. Each of the coins is to be guided to the coin outlet portion 25 in a contact relation with the coin feeding belt 28. The coin feeding belt comprises a coin feeding belt portion 28*a*. The coin feeding belt portion 28*a* directly extends, on a plane including the front surface of the coin feeding disc 2. A guiding peripheral wall portion 27 is provided in somewhat short of a coin outlet 26 with respect to the rotation direction of the coin feeding disc 2. The coin feeding belt portion 28*a* extends from the guiding peripheral wall portion 27 to the coin outlet 26. The coin feeding belt 28 moves in a rotation direction of the coin feeding disc 2 in a manner described below.

The belt driving member comprises a belt driving pulley 33. The belt driving pulley 33 is rotatably supported by a shaft 30. In addition, the belt driving pulley 33 is rotated by means of the coin feeding disc 2 in firm frictional contact therewith. More particularly, the belt driving pulley 33 is frictionally contact with a peripheral surface of the coin feeding disc 2. The belt driving member also comprises two guide pulleys 34 and 35. Each of the guide pulleys 34 and 35 is rotatably supported by shaft 31 and 32, respectively. As illustrated in FIG. 1, centers of the three shafts 30, 31 and 32 are located at points A, B and C, respectively. Each of the points A, B and C corresponds to each vertex of a triangle extending on a plane Including the surface of the coin feeding disc 2. Each shaft is disposed integrally to the inclined base plate 1 and the endless coin feeding belt 28 is passed around these pulleys. As mentioned above, the coin feeding belt portion 28*a* is extended between both guide pulleys 34 and 35. Thus, the coin feeding belt portion 28*a* moves between the two guide pulleys 34 and 35 to transport the coin to the coin outlet 26.

The shaft 30 of the driving pulley 33 is attached to a lever 37. One end of the lever 37 is pivotally attached to the inclined base plate 1 by means of a pivot pin 36. The other end of the lever 37 is connected to the inclined base plate 1 through a biasing member in the form of a spring 38. The belt driving pulley 33 is forced towards a peripheral surface of the coin feeding disc 2 due to a spring force of the spring 38. Thus, the belt driving pulley 33 allows to be frictionally contact with a peripheral flange 2*a* of the coin feeding disc 2. In the manner described above, the coin feeding belt 28 is driven by the coin feeding disc 2 through the belt driving pulley 33.

Figure 4:
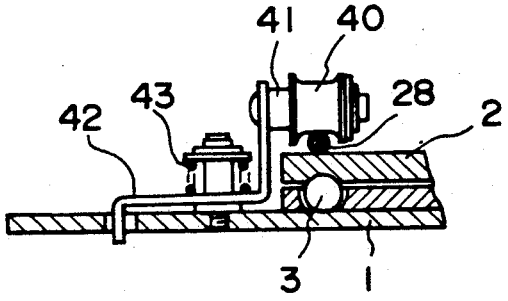
FIG. 4 is a side view of a belt presser roller taken on line IV-IV in FIG. 1.

The coin feeding belt arrangement comprises a belt presser roller 40. As shown in FIG. 4, the belt presser roller 40 is rotatably supported by a roller shaft 41. The roller shaft 41 is secured on a supporting plate 42. A spring 43 is provided on the surface of the supporting plate 42 by means of a screw. Due to the spring force of the spring 43, the belt presser roller 40 allows to press the coin feeding belt portion 28 towards the front surface of the coin feeding disc 2. By providing the belt presser roller 40, the coin is securely transported to the coin outlet 26 in contact relation with the endless belt 28 without being adversely affected by the centrifugal force.

Turning back to FIGS. 1 and 3, a coin counting sensor 46 is provided on the surface of the inclined base plate 1 at a coin outlet chute. An outlet gate 47 is attached to a movable member 49 of an electromagnet 48. When the coin counting sensor 46 detects the predetermined number of coins being passed thereby, the electromagnet 48 is weakened and the gate 47 is moved by means of a spring to the illustrated coin shutdown position to close the coin outlet.

According to the embodiment of the present invention, the coin feeding disc 2 is rotated at a relatively high speed In a hopper in a position inclined to the horizontal. As mentioned above, the coin transporting pieces 8 pick up the coin one by one. Then the picked up coin is transported along the peripheral wall while utilizing the centrifugal force which acts to the coin feeding disc 2. Accordingly, the hopper 4 is no more required to be formed like a dish having a large surface area. The smaller hopper can be used which is sufficiently deep for holding a large number of coins. Further, it is unnecessary to prepare a coin feeding disc 2 having large diameter.

In addition, the coin feeding pieces 8 are not protruded from the surface of the coin feeding disc 2 at the coin outlet portion 25. Accordingly, it is possible to securely and smoothly feed the coins to the coin outlet 26 using the coin feeding belt 28 while effectively utilizing the centrifugal force.

Although the present invention has been described in conjunction with preferred embodiment, it is to be understood that modifications and variations may be resorted to without departing from the spirit and scope of the present invention, as those skilled in the art will readily understand. Such modifications and variations are considered to be within the purview and scope of the present invention and appended claims.

What is claimed is:

1. A coin sorting device comprising:

a rotary plate having a front surface on the side where a coin is loaded at a lower portion thereof and a rear surface on its other side, said rotary plate being adapted for use in feeding said coin to a coin outlet located around a periphery of said front surface;

a coin transporting piece reception hole passing through said rotary plate;

a coin transporting piece carrier adapted to be rotated in synchronism with said rotary plate in an opposed position, said coin transporting piece being inclined to said rear surface of said rotary plate at a predetermined angle;

a coin transporting piece protruding from said coin transporting piece carrier, said coin transporting piece projecting from said front surface and passing through said coin transporting piece reception hole, wherein said coin transporting piece catches said coin at the lower portion of said front surface and feeds it to an upper portion of said front surface, and said predetermined inclination angle is in the range such that said coin transporting piece extends substantially from said front surface as said coin transporting piece approaches the lower portion from the upper portion of said front surface, and that said coin transporting piece is caused to substantially withdraw in said front surface as said coin transporting piece approaches the upper portion from the lower portion of said front surface;

coin feeding belt means for feeding said coin to said coin outlet from the upper portion of said front surface, said coin feeding belt means comprising a belt member for contacting said coin in order to transport said coin from the upper portion of said front surface to said coin outlet; and a belt driving member for driving said belt member in a rotational direction of said rotary plate, said belt driving member comprising a belt driving pulley which is rotated by being in frictional contact with the peripheral surface of said rotary plate.

2. A coin feeding device as claimed in claim 1, wherein said belt member is an endless belt and said belt driving member further comprises two guide pulleys which are located at each respective vertex of a triangle a part of which extends to said front surface, said two guide pulleys being adapted to guide said endless belt to transport said coin from the upper portion of said front surface to said coin outlet.

3. A coin feeding device as claimed in claim 2, further comprising a forcing member for forcing said belt driving pulley towards the peripheral surface of said rotary plate to effect frictional contact with the peripheral surface of said rotary plate.

4. A coin feeding device as claimed in claim 1, wherein said coin feeding belt means comprises a belt pressure member for applying pressure to said belt member in the direction of said front surface to assure transportation of said coin to said coin outlet.

5. A coin feeding device as claimed in any one of claims 1 through 4, further comprising an agitating member for agitating said coins loaded at the lower portion of the front surface and located around an inside of said front surface.

6. A coin feeding device as claimed in claim 5, further comprising an agitating member receiving hole which passes through said rotary plate, wherein said agitating member protrudes from said coin transporting piece carrier and projects from said front surface passing through said agitating member reception hole, wherein said predetermined inclination angle is in the range such that said agitating member substantially extends from said front surface as said agitating member approaches the lower portion from the upper portion of said front surface, and wherein said agitating member is substantially withdrawn in said front surface as said agitating member approaches said upper portion from the lower portion of said front surface.

* * * * *